US006954966B2

(12) United States Patent
Shimizu et al.

(10) Patent No.: US 6,954,966 B2
(45) Date of Patent: Oct. 18, 2005

(54) CLEANER FOR USE IN NURSING CARE

(75) Inventors: Tetsuhiko Shimizu, Matsumoto (JP); Yoshiyuki Mimura, Matsumoto (JP)

(73) Assignee: Izumi Products Company, Nagano (JP)

( * ) Notice: Subject to any disclaimer, the term of this patent is extended or adjusted under 35 U.S.C. 154(b) by 326 days.

(21) Appl. No.: 10/293,184

(22) Filed: Nov. 12, 2002

(65) Prior Publication Data

US 2004/0088816 A1 May 13, 2004

(51) Int. Cl.[7] ..... A47L 9/28

(52) U.S. Cl. ..... 15/319; 15/321; 15/339; 15/353; 73/296

(58) Field of Search ..... 15/321, 319, 339, 15/353; 73/296, 149; 177/245; 200/85 R; 240/666

(56) References Cited

U.S. PATENT DOCUMENTS 3,574,239 A * 4/1971 Sollerud ..... 15/321
4,207,649 A * 6/1980 Bates ..... 15/319
4,227,279 A * 10/1980 Tribolet ..... 15/321
4,463,474 A * 8/1984 Jacobs ..... 15/353
4,724,573 A * 2/1988 Ostergaard ..... 15/321
5,133,212 A * 7/1992 Grills et al. ..... 73/296
5,237,720 A * 8/1993 Blase et al. ..... 15/321
5,301,386 A * 4/1994 Thomas et al. ..... 15/321
6,061,868 A * 5/2000 Moritsch et al. ..... 15/339

* cited by examiner

*Primary Examiner*—Theresa T. Snider
(74) *Attorney, Agent, or Firm*—Koda & Androlia

(57) ABSTRACT

A cleaner for use in nursing care including: a warm-water tank, a contaminated-water tank, a head assembly which sprays warm water supplied from the warn-water tank, and a suction mechanism which sucks water and contaminants along with air into the contaminated-water tank from the head assembly via a suction hose, separates water and contaminants from air by a separator assembly, and collects water and contaminants in the contaminated-water tank; wherein the contaminated-water tank and the warm-water tank are accommodated in the main body casing of the cleaner, and a weight sensor which detects then amount of contaminated water collected in the contaminated-water tank is installed in the bottom of an accommodating section that is provided in the main body casing and accommodates the contaminated-water tank.

4 Claims, 5 Drawing Sheets

CLEANER FOR USE IN NURSING CARE

BACKGROUND OF THE INVENTION

1. Field of the Invention

The present invention relates to a cleaner for use in nursing care and more particularly to a cleaner for use in nursing care which is used to clean the bodies of nursing care patients such as elderly persons, invalids, etc.

2. Prior Art

For nursing care providers who provide nursing care to elderly persons or invalids, etc., constantly maintaining the cleanliness of nursing care patients such as elderly persons or invalids, etc., is an extremely bothersome task. One method that is commonly used in cases where nursing care patients cannot use the toilet under their own power is a method using diapers. In this case, the caregiver must appropriately change the diapers of the nursing care patients. In cases where the nursing care patient's body is soiled during this changing, the body is cleaned by wiping the body with a towel, etc. However, in the case of such a method in which the body is wiped with a towel, etc., the body is often not completely cleaned; in such cases, it is necessary to rinse the body with warm water, or in some cases to rinse the body by placing the patient in a bath.

Thus, in nursing care provided to elderly persons and invalids, etc., a great deal of effort is expended in the work of disposing of excretory products and cleaning of the patient's bodies. Accordingly, various devices have been proposed with the aim of lightening the labor required in such nursing care work. For example, devices in which warm water (cleaning water) is sprayed on the nursing care patient's body, and the body is cleaned by removing the sprayed water by suction, have been proposed in Japanese Patent Application Laid-Open (Kokai) No. 9-23425, Japanese Patent Application Laid-Open (Kokai) No. 11-19603 and Japanese Patent Application Laid-Open (Kokai) No. 2000-51313, etc. In these devices, warm water can be sprayed directly onto contaminated areas of the body, so that these areas are rinsed; accordingly, excretory products adhering to the body can be cleanly removed, so that the body can easily be cleaned.

In devices that remove contaminants from the body by spraying the body with warm water, the spray nozzle is installed concentrically with a suction pipe; such devices are constructed so that warm water is sprayed from the spray nozzle, and the warm water thus sprayed is removed by vacuum suction that is applied from the suction port of the suction pipe. Such devices are equipped with a warm-water tank that supplies the warm water, and a contaminated-water tank in which the contaminated water that is removed by suction is collected. Accordingly, since problems are created if the contaminated water overflows from the contaminated-water tank, a water amount gauge is installed in the contaminated-water tank so that the amount of contaminated water can be detected; furthermore, such devices are constructed so that cleaning of the contaminated-water tank is facilitated, and the devices are made portable so that handling is facilitated.

SUMMARY OF THE INVENTION

The object of the present invention is to allow secure detection of the amount of contaminated water in the contaminated-water tank of such a cleaner used in nursing care which is equipped with a warm-water tank and a contaminated-water tank, and which cleans the body by spraying warm water onto the body, so that such a cleaner used in nursing care can be provided as a commercial product in which the handling characteristics of the cleaner are further improved.

More specifically, in the cleaner for use in nursing care that includes: a warm-water tank; a contaminated-water tank; a head assembly which sprays warm water supplied from the warn-water tank; and a suction mechanism which sucks water and contaminants along with air into the contaminated-water tank from the head assembly via a suction hose, separates water and contaminants from air by a separator assembly, and collects water and contaminants in the contaminated-water tank; and in this cleaner, the contaminated-water tank and warm-water tank are installed in the main body casing of the cleaner, and a weight sensor which detects the amount of contaminated water collected in the contaminated-water tank is installed in the bottom portion of an storage section that is provided in the main body casing and stores the contaminated-water tank therein.

In the above-structure, a sensor that detects whether or not the contaminated-water tank has been set in the storage section of the main body casing is installed in the main body casing.

Furthermore, the suction mechanism has a suction flow generating section that generates an air suction flow by rotationally driving a fan installed inside a fan compartment;

the separator assembly has a fan, which is rotationally driven by the suction flow, and a separator, which rotates as an integral unit together with the fan; and in addition, the separator assembly is detachably provided via an air-seal at an opening of the contaminated-water tank, so that the contaminated-water tank, the separator assembly and the suction flow generating section can be communicated.

Furthermore, the separator assembly is supported by a supporting element and is communicated with the suction flow generating section; and the supporting element is installed so as to be pivotable between a set position and an open position. In the set position, the supporting element is in a horizontal position so that the separator assembly is communicated with the opening formed in an upper portion of the contaminated-water tank; and in the open position, the supporting element is set to stand upright so that the separator assembly is separated from the contaminated-water tank.

In addition, the opening of the contaminated-water tank has a larger diameter than the diameter of the separator, a ring-form contaminated-water cover is detachably installed in the opening of the contaminated-water tank, and the separator assembly is detachably installed in the contaminated-water cover. With a structure in which the contaminated-water cover is mounted in the opening of the contaminated-water tank, the contaminated water can be easily dumped, and the interior of the contaminated-water tank can be easily cleaned by removing the contaminated-water cover.

DETAILED DESCRIPTION OF THE INVENTION

Below, preferred embodiments of the cleaner for use in nursing care provided by the present invention will be described in detail with reference to the accompanying drawings.

Figure 1:
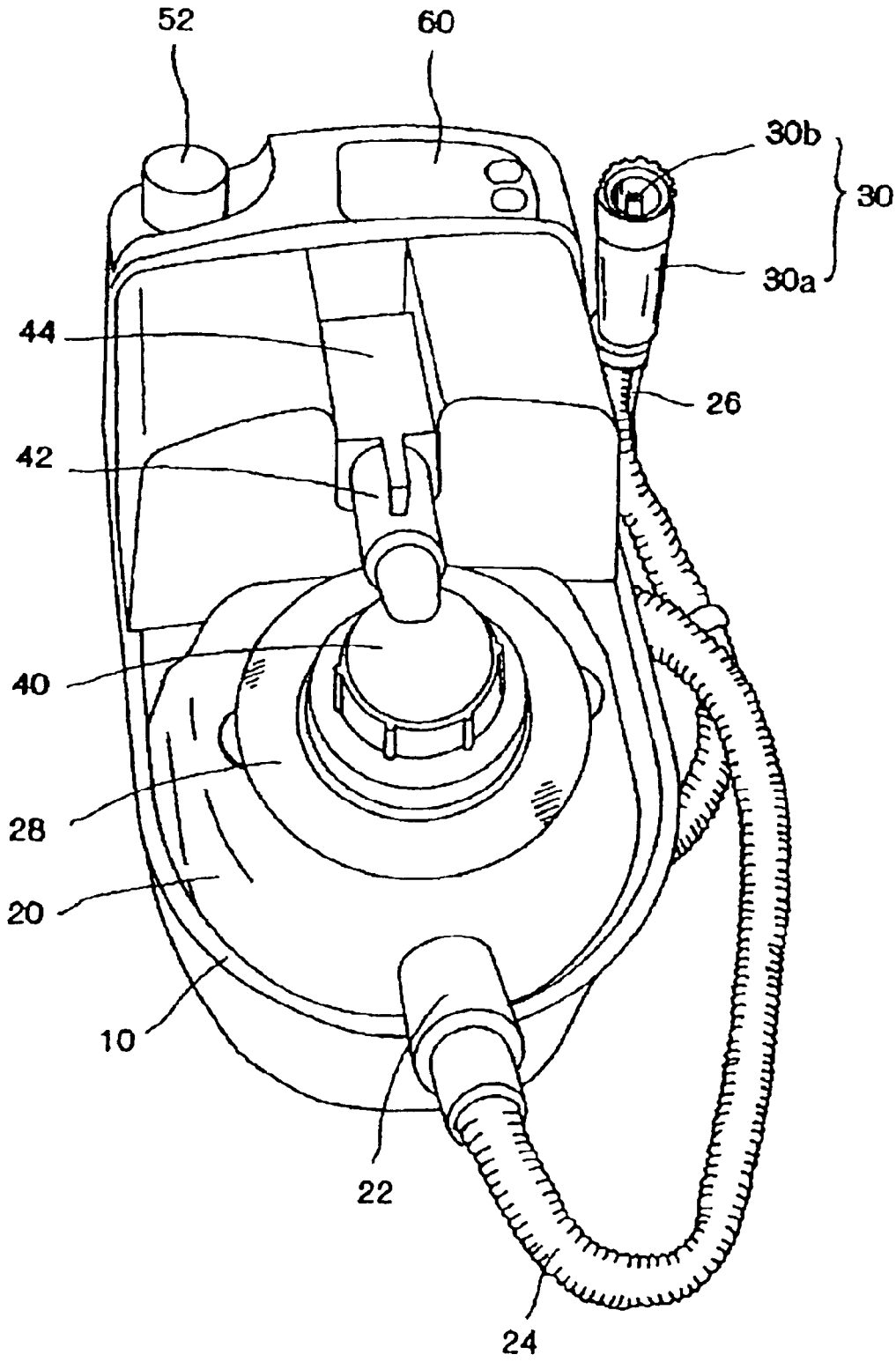
FIG. 1 is a perspective view illustrating the structure of the cleaner for use in nursing care provided by the present invention.

FIG. 1 is a perspective view that shows the overall structure of the cleaner for use in nursing care provided by the present invention. The reference numeral 10 is the main body casing of the cleaner for use in nursing care, and 20 refers to a contaminated-water tank which is installed in the main body casing 10.

Figure 2:
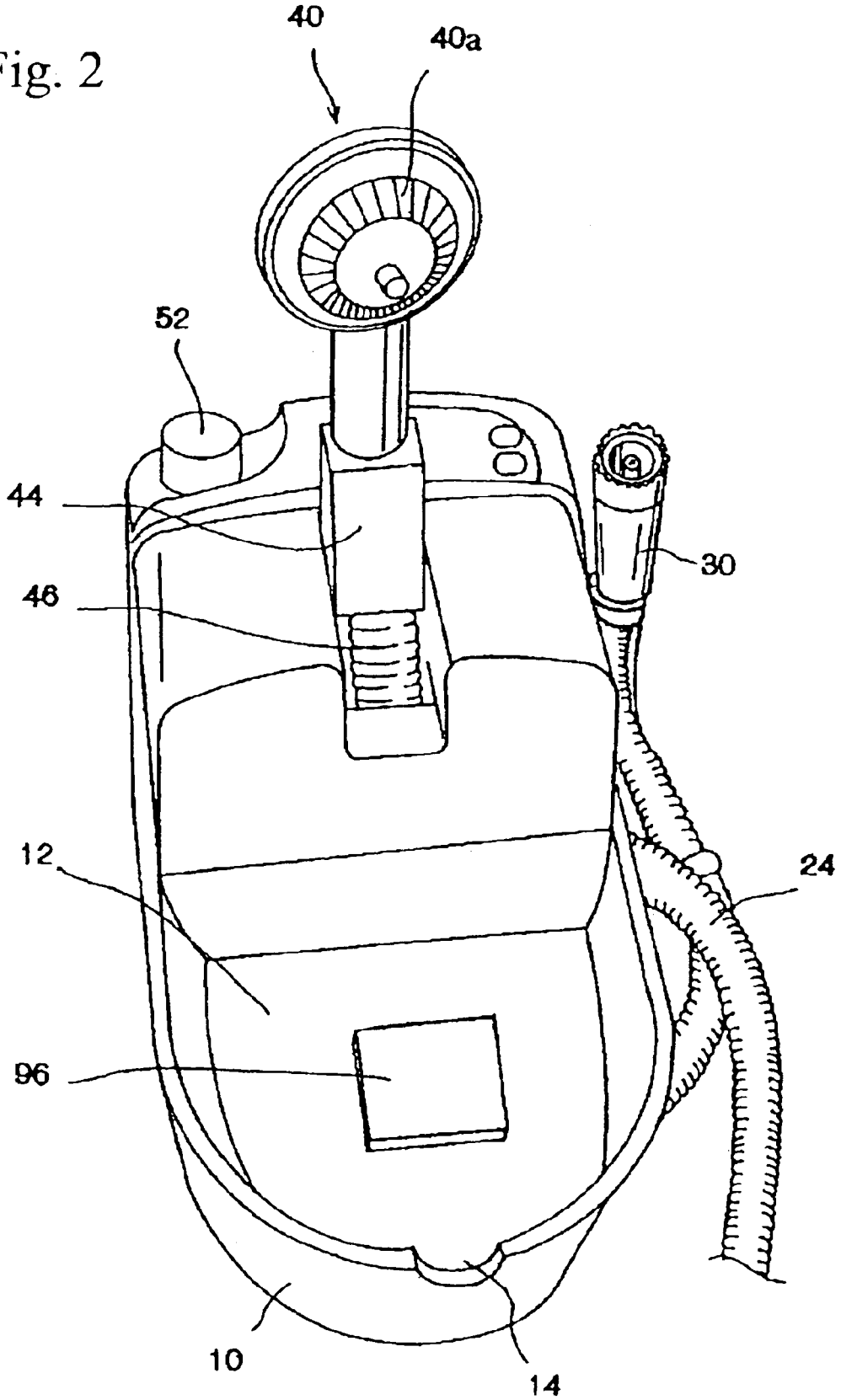
FIG. 2 is a perspective view showing the state in which the contaminated-water tank has been removed from the main body casing of the nursing-care cleaner.

As shown in FIG. 2, a storage section 12 that stores the contaminated-water tank 20 therein is disposed in the front portion of the main body casing 10. The storage section 12 is in the form of a box with its entire upper portion open. The contaminated-water tank 20 can be installed in and removed from the storage section 12 by moving the contaminated-water tank 20 in the vertical direction. A duct 22 is formed in the front portion of the contaminated-water tank 20, and an engaging recess 14 is formed in the upper edge of the main body casing 10 so as to be at the front portion of the storage section 12. The duct 22 is engaged with the engaging recess 14. When the contaminated-water tank 20 is to be set in the storage section 12, the duct 22 of the contaminated-water tank 20 is aligned with the engaging recess 14 of the main body casing 10.

As shown in FIG. 1, the contaminated-water tank 20 has a size in which the upper portion of the contaminated-water tank 20 is slightly exposed from the storage section 12 when the contaminated-water tank 20 is set in the storage section 12. The contaminated-water tank 20 sucks in and collects, together with contaminants, the warm water that is sprayed onto the body of the nursing care patient. Thus, the contaminated-water tank 20 has a capacity that is sufficient for the cleaning treatment to be performed several times.

A suction hose 24 is connected to the duct 22 of the contaminated-water tank 20, and a head assembly 30 is attached to the tip end of this suction hose 24. The head assembly 30 includes a suction pipe 30*a*, which is in a cylindrical shape, and a spray nozzle 30*b*, which is disposed inside the suction pipe 30*a* so that the spray port of the spray nozzle 30*b* faces the opening of the suction pipe 30*a*.

The suction pipe 30*a* is communicated with the suction hose 24, and the spray nozzle 30*b* is connected to a warm water supply mechanism. In the shown device, warm water used for cleaning is fed to the spray nozzle 30*b* from the warm water supply mechanism, and the warm water that has been sprayed onto the nursing care patient is sucked via the suction pipe 30*a* or suction hose 24 and collected in the contaminated-water tank 20 by placing the suction hose 24 under a negative pressure. Numerous recesses and projections are formed in the circumferential direction in the rim of the opening of the suction pipe 30*a*, so that when the head assembly 30 is placed against the body of the nursing care patient, spaces through which air can flow are formed between the surface of the skin of the patient's body and the rim of the opening in the suction pipe 30*a*. As a result, the sprayed warm water is sucked into the suction pipe 30*a* together with the air around the head assembly 30.

When warm water is sucked from the head assembly 30 via the suction hose 24, a mixture of contaminants and air is sucked in together with the water. In the nursing-care cleaner of the shown embodiment, an air flow for suction use is generated by rotationally driving a suction fan by a motor; the contaminated-water tank 20 side is placed under a negative pressure by this suction air, so that water, etc. is sucked from the head assembly 30 via the suction hose 24. The water and contaminants flowing into the contaminated-water tank 20 are separated from gases by a separator, so that only air is discharged.

In FIG. 1, the reference numeral 40 is a separator assembly, and this separator assembly 40 is mounted on the contaminated-water tank 20. The separator assembly 40 is comprised of a fan a separator. The fan is caused to rotate by the above-described airflow that is used for suction, and the separator is integrally connected to the fan and is rotated together with the fan. The reference numeral 42 is a connecting duct. The connecting duct 42 is connected to the separator assembly 40, and a supporting pipe 44 pivotally supports the separator assembly 40 at two different positions: a set position in which the separator assembly 40 is set on the contaminated-water tank 20, and an open position in which the separator assembly 40 is separated from the contaminated-water tank 20.

FIG. 1 shows a state in which the separator assembly 40 is set on the contaminated-water tank 20. As seen from FIG. 1, the separator assembly 40 is set on the contaminated-water tank 20 so as to have a communication with the interior of the contaminated-water tank 20 when the supporting pipe 44 is pivotally moved to be pushed over on its side. A contaminated-water cover 28 is detachably mounted on the circumferential rim of the opening of the contaminated-water tank 20. The contaminated-water cover 28 has a ring shape, and it allows the separator assembly 40 to be mounted on the opening of the contaminated-water tank 20 with an air-tight seal in between.

Figure 3:
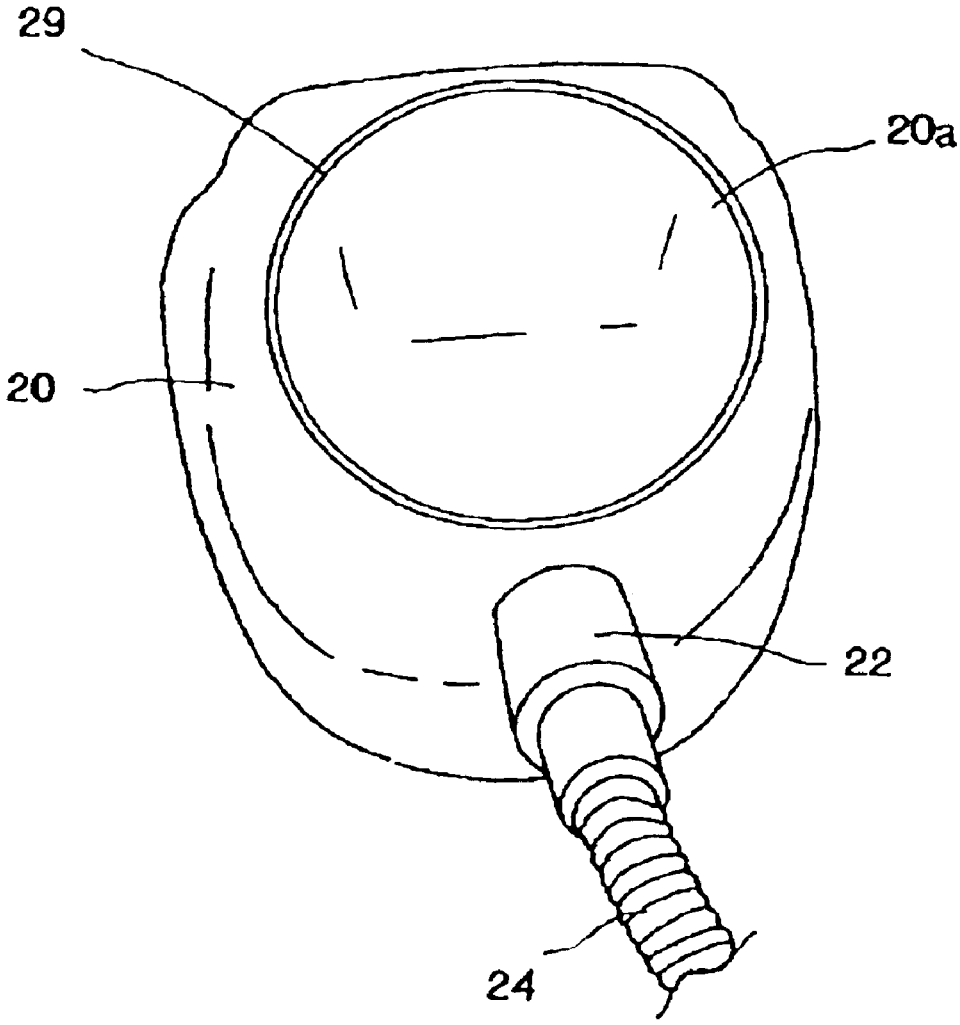
FIG. 3 is a perspective view of the contaminated-water tank used in the nursing-care cleaner.

FIG. 3 shows the main body of the contaminated-water tank 20 before the contaminated-water cover 28 is put thereon. A wide opening 20*a* is formed in the upper portion of the contaminated-water tank 20. In the shown embodiment, the contaminated-water cover 28 (which is formed in the form of a ring) is set on the opening 20*a* of the contaminated-water tank 20; thus, the diameter of the opening 20*a* of the contaminated-water tank 20 is reduced by such a cover 28, and the separator assembly 40 is mounted in this opening that is reduced in diameter by the cover 28. The reference numeral 29 is a sealing member 29, and this sealing member 29 is mounted on the opening of the contaminated-water tank 20 so that the contaminated-water cover 28 is set on the contaminated-water tank 20 in an air-tight fashion. The sealing member 29 is installed along the rim of the opening 20*a*.

Since the contaminated-water tank 20 of the shown embodiment takes the structure in which the contaminated-water cover 28 is mounted in the opening 20*a* of the contaminated-water tank 20, the opening 20*a* can be opened as widely as possible. As a result, cleaning of the interior of the contaminated-water tank 20 is facilitated, and handling of the contaminated-water tank 20 is also made easier. Furthermore, since the structure employed is that the separator assembly 40 and contaminated-water tank 20 are communicated with each other via the contaminated-water cover 28, the separator assembly 40 is communicated with the contaminated-water cover 28 in a sealed manner; and the contaminated-water tank 20 has a simple structure.

In FIG. 1, the reference numeral 52 is a water supply cap which opens and closes the water supply port that supplies water to the warm-water tank. The warm-water tank stores cleaning water such as tap water, etc. The warm water tank contains a heater so that the water inside can be heated. A water supply tube 26 is connected to the warm-water tank and head assembly 30, and clean warm water is supplied to the spray nozzle 30*b* by a pump.

The reference numeral 60 is a control panel which is used to control the cleaning operation.

Furthermore, a cover 70 (see FIG. 4) which covers the contaminated-water tank 20 and separator assembly 40 is disposed above the storage section 12 of the main body casing 10 that stores the contaminated-water tank 20 therein. For the convenience of description, in FIG. 1, the cover 70 is removed.

Figure 4:
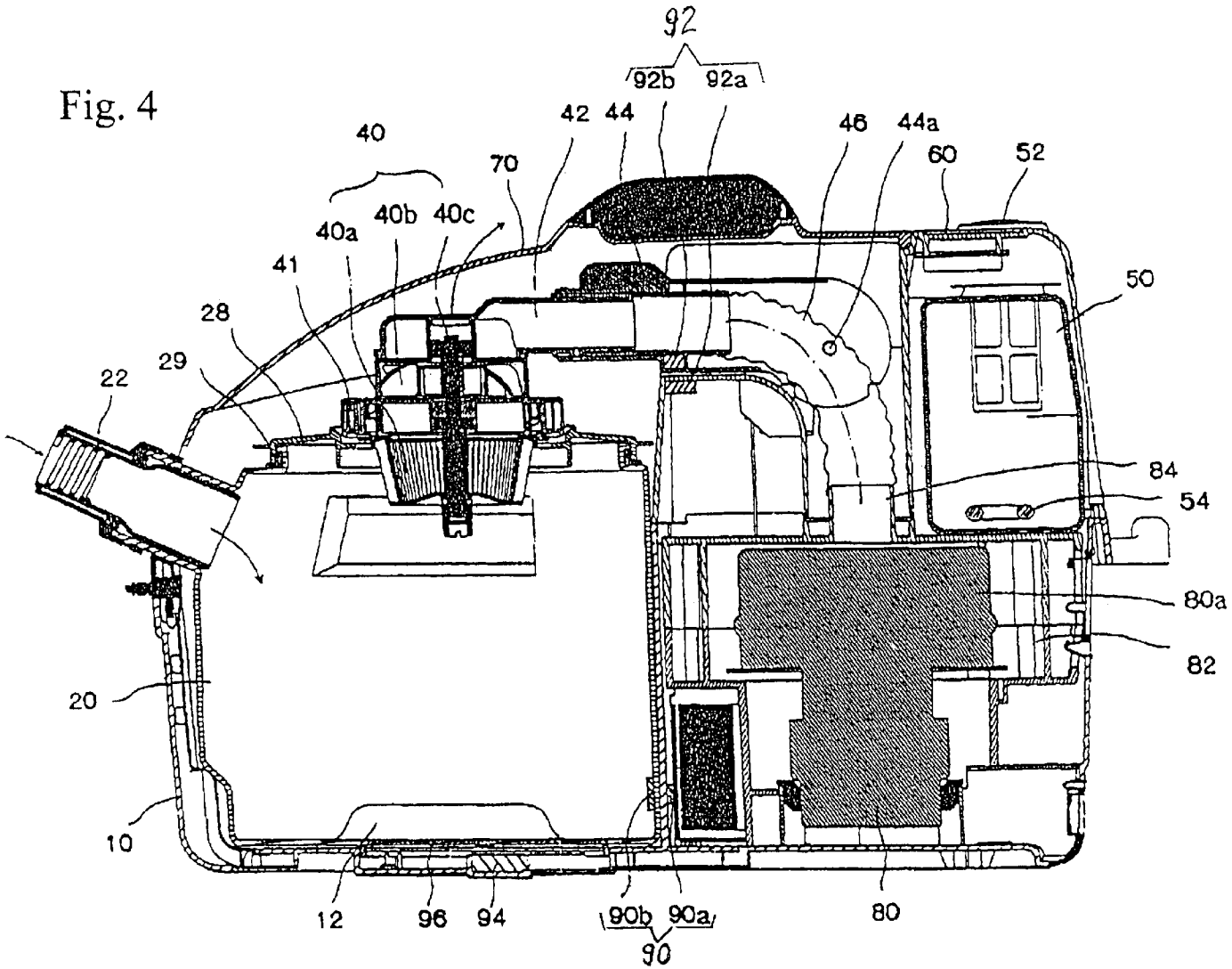
FIG. 4 is a sectional view showing the structure of the components of the nursing-care cleaner of the present invention.

FIG. 4 is a sectional view showing the structure of the cleaner for use in nursing care of the shown embodiment. The storage section 12 that stores the contaminated-water tank 20 therein is disposed on the front side of the main body casing 10, and an electric motor 80 and a fan 80*a* are disposed in the lower portion of the rear side of the main body casing 10. Furthermore, a warm-water tank 50 is disposed in the upper portion of the rear side of the main body casing 10. The reference numeral 54 is a heater that heats the water that is supplied into the warm-water tank 50. As a result of the cover 70 mounted on the upper portion of the front side of the main body casing 10, the nursing-care cleaner as a whole takes a rectangular box-form configuration in which the respective components are compactly installed in the main body casing 10.

As described above, the contaminated-water cover 28 is mounted in the opening of the contaminated-water tank 20 with sealing member 29 in between so that a seal is formed. The separator assembly 40 that separates the water, contaminants and gas (air) that flow into the contaminated-water tank 20 includes a fan 40*b* and a separator 40*a* which is disposed so that this separator 40*a* protrudes toward the contaminated-water tank 20. The separator 40*a* and fan 40*b* are fastened on a common shaft 40*c* and are thus rotated as a unit. The shaft 40*c* is shaft-supported so that this shaft 40*c* is free to rotate on a casing part that communicates with the connecting duct 42. The fan 40*b* is caused to rotate by the air flow that is used for suction, and thus the separator 40*a* is rotationally driven together with this fan 40*b*. The lower portion of the separator 40*a* is formed in the shape of a cylinder which has a bottom and which has a slightly reduced diameter. The separator 40*a* has numerous slits formed in its side surfaces.

The communication between the separator assembly 40 and the contaminated-water tank 20 is accomplished with an air-tight seal formed in between; and this air-tight seal is obtained by the sealing member 41 which is disposed on the outer circumferential surface of the of the case part that supports the separator 40*a*, and which makes contact with the opening rim of the contaminated-water cover 28. Since the interior of the contaminated-water tank 20 is placed under a negative pressure during the cleaning operation, the sealing member 41 is strongly pressed against the opening of the contaminated-water cover 28 by atmospheric pressure. As a result, the separator assembly 40 and contaminated-water tank 20 are connected even more securely with a formed air-tight seal in between.

The separator assembly 40 is connected to the supporting pipe 44 via the connecting duct 42 and is thus supported by the supporting pipe 44 so that the separator assembly 40 can pivot. The reference numeral 44*a* is a pivoting shaft that pivot-supports the supporting pipe 44. The supporting pipe 44 is thus provided so as to pivot about the shaft 44*a* and to be in a set position and in an open position.

The reference numeral 46 is a connecting hose which connects the connecting duct 42 and a fan chamber 82. The connecting hose 46 possesses flexibility and connects a short cylindrical element 84 that extends from the fan chamber 82 with the end of the connecting duct 42 so that the hose 46 can expand and contract. Inside the fan chamber 82, the fan 80*a* is rotated by the electric motor 80, so that a suction flow of air oriented in the direction that discharges air from the contaminated-water tank 20 is generated. The fan 80*a*, electric motor 80 and fan chamber 82 constitute an air suction flow generating section.

In the nursing-care cleaner of the shown embodiment, in order to prevent operating mistakes, a sensor which detects the contaminated-water tank 20 set in the main body casing 10, a sensor which detects the connection of the separator assembly 40 to the contaminated-water tank 20, and a sensor which detects the amount of contaminated water that has been collected in the interior of the contaminated-water tank 20, are provided.

The sensor 90, which detects whether or not the contaminated-water tank 20 has been set in the main body casing 10, is comprised of a lead switch 90*a* and a magnet 90*b*. The lead switch 90*a* is disposed on the lower portion of the side surface of the rear part of the storage section 12 of the main body casing 10, and the magnet 90*b* is attached to the contaminated-water tank 20. The magnet 90*b* is provided at a position that faces the lead switch 90*a* when the contaminated-water tank 20 is set in the storage section 12 of the main body casing 10. When the contaminated-water tank 20 is set in the storage section 12, the lead switch 90*a* is powered by the magnetic force of the magnet 90*b*, and it is detected that the contaminated-water tank 20 has been set in the storage section 12.

The sensor 92, which detects whether or not the separator assembly 40 has been connected to the contaminated-water tank 20, is comprised of a lead switch 92*a* and a magnet 92*b*. The lead switch 92*a* is fastened to the main body casing 10, and the magnet 92*b* is attached to the supporting pipe 44 that supports the separator assembly 40. The lead switch 92*a* is provided at a position where the magnet 92*b* disposed on the supporting pipe 44 faces the lead switch 92*a* in a state in which the separator assembly 40 is pushed over into a horizontal orientation and placed in the set position. When the separator assembly 40 is pushed over into the set position, the magnet 92*b* approaches the lead switch 92*a*, and the lead switch 92*a* is powered; as a result, it is detected that the separator assembly 40 has been set in the set position.

The weight sensor 94, which detects the amount of contaminated water that has been collected in the contaminated-water tank 20, is installed in the bottom of the storage section 12 of the main body casing 10. The weight sensor 94 detects the amount of contaminated water according to the weight of the contaminated water that has been collected in the contaminated-water tank 20. The sensor 94 is installed on the undersurface of a plate 96 which is provided in an upwardly and downwardly movable fashion. When the plate 96 is pressed by the weight of the contaminated-water tank 20 and the contaminated water inside the contaminated-water tank 20, the amount of contaminated water that has been collected in the contaminated-water tank 20 is detected.

The manner of use of the nursing-care cleaner of the embodiment shown above will be described below.

The cleaning operation is performed in a state in which the contaminated-water tank 20 is set in the main body casing 10, and the supporting pipe 44 is pushed over so that the separator assembly 40 is communicated with the contaminated-water tank 20. The sensor 90 detects whether or not the contaminated-water tank 20 has been set in the main body casing 10. In a case where the contaminated-water tank 20 has not been set in the main body casing 10, the switch for starting the cleaning operation by means of the operating panel 60 cannot be turned ON. Likewise, when the separator assembly 40 has not been brought to communicate with the contaminated-water tank 20, the fact that the separator assembly 40 has not been mounted is detected by the sensor 92, and the switch for starting cleaning operation cannot be turned ON.

When the contaminated-water tank 20 and separator assembly 40 have been correctly set, then the desired cleaning operation is set by the operating panel 60, and the cleaning operation is started.

In the nursing-care cleaner of the shown embodiment, the temperature of the warm water can be adjusted by operating a button on the operating panel 60, and the starting and stopping of the cleaning operation are controlled by means of an ON-OFF button. When cleaning is initiated, the motor used for suction is first switched ON; then, the pump that supplies warm water is switched ON. When cleaning is stopped, the pump that supplies the warm water is switched OFF; then, after several seconds, the device is controlled so that the motor used for suction is stopped. Furthermore, a setting button which applies suction only to the suction hose 24 is also provided for use in clean-up of the suction hose 24. When the suction hose 24 is to be cleaned up, the interior of the suction hose 24 is cleaned by sucking clean water from the suction hose 24.

In the cleaning operation applied to a patient, the head assembly 30 is removed from a hook disposed on the side surface of the main body casing 10, and the cleaner is operated while moving the head assembly 30 so that the opening of the head assembly 30 contacts the soiled areas of the body of the patient. Warm water is supplied from the warm-water tank 50 by the pump, and this warm water is emitted in the form of a spray from the spray nozzle 30*b*. The warm water emitted from the spray nozzle 30*b* is sprayed onto the patient's body, so that contaminants, etc., adhering to the patient's body are washed away by this warm water. The sprayed warm water is sucked into the interior of the suction hose 24 together with an air flow from the suction pipe 30*a* and is led into the contaminated-water tank 20.

Air is sucked into the contaminated-water tank 20 together with water and contaminants. This suction action is accomplished by the flow of suction air through an air space that communicates with the connecting hose 46, connecting duct 42, separator assembly 40, contaminated-water tank 20, suction hose 24 and head assembly 30 from the fan chamber 82.

The separator assembly 40 separates the water and contaminants that are drawn into the contaminated-water tank 20 together with the air from this air. In particular, the separator 40*a* of the separator assembly 40 is rotatable as a unit with the fan 40*b*; and thus when the fan 40*b* is rotated at a high speed by the suction air flow generated by the fan 80*a*, the separator 40*a* itself is also rotated at a high speed. Slits are formed in the side surfaces of the separator 40*a*; and as a result of the high-speed rotation of the separator 40*a*, water and contaminants are caused to rebound from the separator 40*a*, and only the gas component is allowed to pass through the slits. As a result, an action that separates the gas component from the solid and liquid matter is performed. In other words, as a result of the separator assembly 40 being interposed in the air space through which the suction air flows, the water and contaminants that are drawn into the contaminated-water tank 20 are separated from the air and are sucked into the connecting duct 42.

The air that is sucked in from the head assembly 30 passes through the separator assembly 40 and is discharged, while the water and contaminants are collected in the contaminated-water tank 20. In this way, water and contaminants are collected in the contaminated-water tank 20 as the patient's body is washed by spraying warm water from the head assembly 30.

The weight sensor 94 detects the weight of the contaminated-water tank 20 and stops the cleaning operation when the weight of the contaminated-water tank 20 exceeds a predetermined value. In other words, the weight sensor 94 detects the predetermined quantity of contaminated water collected in the contaminated-water tank 20 and prevents further suction of contaminated water into the contaminated-water tank 20.

Figure 5:
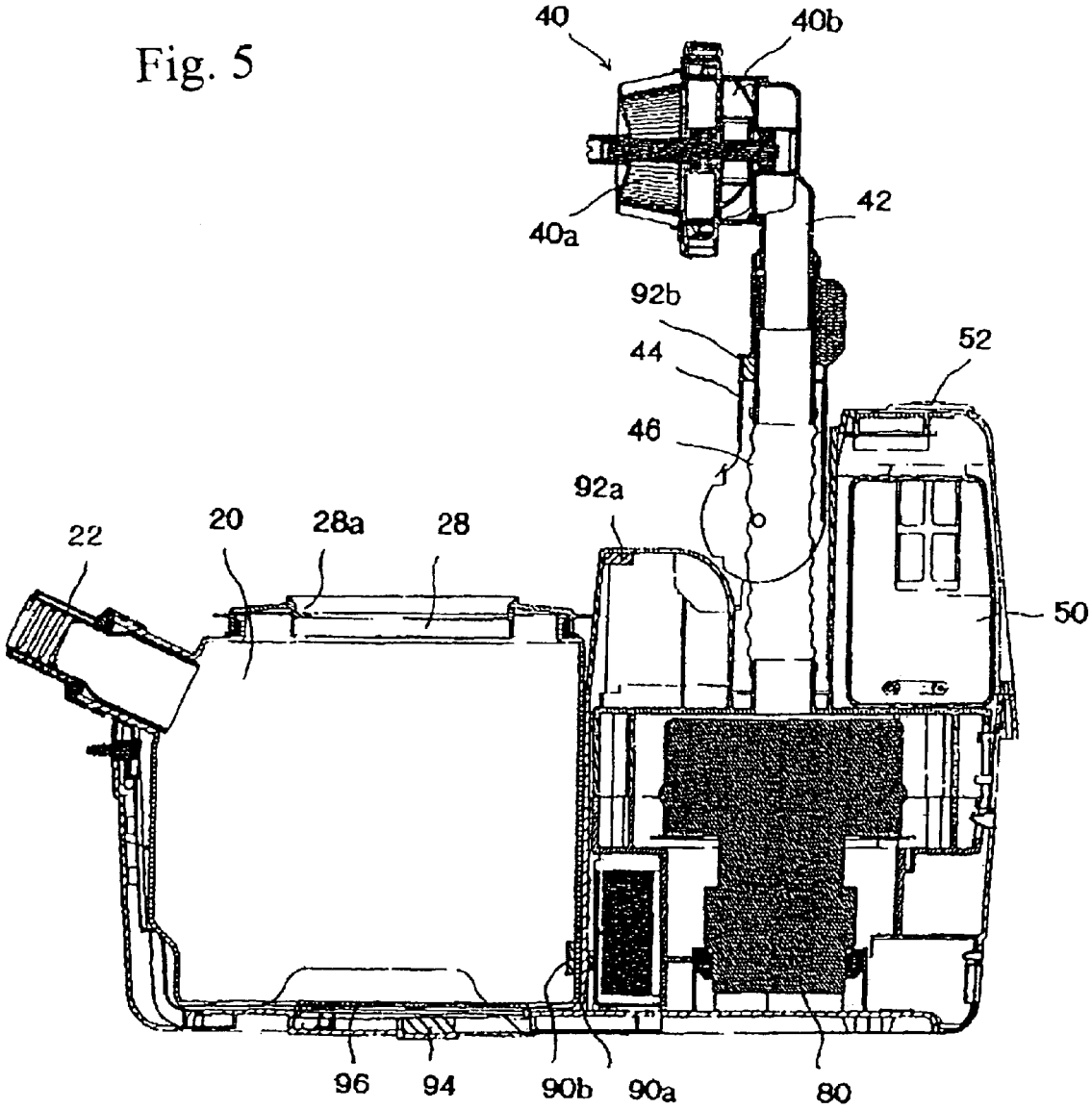
FIG. 5 is a sectional view of the nursing-care cleaner in the state in which the separator assembly is in the open position.

When the contaminated water that has been collected in the contaminated-water tank 20 is to be discarded, the supporting pipe 44 is first pivoted upward so that the separator assembly 40 is separated from the contaminated-water tank 20 as shown in FIG. 5. Since the separator assembly 40 communicates with the contaminated-water tank 20 by merely contacting the opening 28*a* of the contaminated-water cover 28 mounted on the contaminated-water tank 20, the separator assembly 40 can easily be removed from the contaminated-water tank 20 by pivoting the supporting pipe 44 upward. When the supporting pipe 44 is thus pivoted upward into a more or less vertical position, the separator assembly 40 is retracted to the rear (open position) of the storage section 12 formed in the front portion of the main body casing 10, so that the contaminated-water tank 20 can easily be taken out of the storage section 12 by lifting it.

FIG. 2 shows the state in which the separator assembly 40 has been pivoted upward, and the contaminated-water tank 20 has been removed from the storage section 12. When the separator assembly 40 is pivoted upward, the separator 40*a* is brought so as to face forward. Furthermore, the plate 96 that has the weight sensor 94 on its undersurface is in a configuration that it protrudes upward in the bottom of the storage section 12.

Contaminated water can easily be discarded from the contaminated-water tank 20 by removing the contaminated-water cover 28 from the opening 20*a* of the contaminated-water tank 20, and the interior of the contaminated-water tank 20 can be cleaned. The duct 22 of the contaminated-water tank 20 and the suction hose 24 can be freely detached. Accordingly, the suction hose 24 can be removed form the contaminated-water tank 20, and the contaminated-water tank 20 can be washed. Furthermore, the suction hose 24 can also be separately washed.

The storage section 12 of the main body casing 10 is formed so as to conform to the external shape of the contaminated-water tank 20. Thus, the contaminated-water tank 20 is positioned properly by merely inserting the contaminated-water tank 20 into the storage section 12 "as is". After the suction hose 24 is connected to the duct 22 of the contaminated-water tank 20, and the contaminated-water cover 28 is mounted in the opening 20*a* of the contaminated-water tank 20, the separator assembly 40 is brought to communicate with the contaminated-water tank 20. The separator assembly 40 comes into contact with the opening 28*a* of the contaminated-water cover 28 by being pivoted down (into the set position) from the open position, so that the contaminated-water tank 20 and separator assembly 40 are connected and communicated. The above-described operation in which the contaminated-water tank 20 and separator assembly 40 are attached and detached by way of pivoting the separator assembly 40 between the set position and the open position via the supporting pipe 44 is easy to be done. Accordingly, the cleaner device is advantageous in that the attaching and detaching of the separator assembly 40 and contaminated-water tank 20 is accomplished easily and reliably.

After the contaminated-water tank 20 has been set in the main body casing 10 and the separator assembly 40 has been connected to the contaminated-water tank 20, the cover 70 is mounted on the main body casing 10, and the cleaning operation is then started in the manner described above.

In the nursing-care cleaner of the shown embodiment, the respective components such as the contaminated-water tank 20, warm-water tank 50 and electric motor 80 are compactly installed in the main body casing 10, the contaminated-water tank 20 can easily be installed and removed, and the timing for discarding the contaminated water in the contaminated-water tank 20 is known by using the weight sensor that detects the amount of contaminated water collected in the contaminated-water tank 20. Accordingly, the nursing-care cleaner can be easily used without any operation errors.

As described above, in the nursing-care cleaner of the present invention, the amount of contaminated water that has been collected in the contaminated-water tank is detected by a weight sensor. Accordingly, no overflow of contaminated water from the contaminated-water tank occurs, so that the cleaner can be safely and conveniently used and can be provided as an easy-to-handle nursing-care cleaner. Furthermore, since the sensor that detects whether or not the contaminated-water tank has been set in the main body casing is provided, the present invention has conspicuous advantages to avoid faulty operations such as performing the cleaning operation without setting the contaminated-water tank in place.

What is claimed is:

1. A cleaner for use in nursing care, comprising:

a warm-water tank, a contaminated-water tank, a head assembly which sprays warm water supplied from the warn-water tank, and a suction mechanism which sucks water and contaminants along with air into said contaminated-water tank from said head assembly via a suction hose, separates water and contaminants from air by a separator assembly, and collects water and contaminants in said contaminated-water tank; wherein said contaminated-water tank and warm-water tank are installed in a main body casing of said cleaner, and a weight sensor which detects an amount of contaminated water collected in said contaminated-water tank is installed in a bottom portion of a storage section that is provided in said main body casing and stores said contaminated-water tank therein; and wherein said suction mechanism has a suction flow generating section that generates an air suction flow by rotationally driving a fan installed inside a fan compartment, said separator assembly has a fan, which is rotationally driven by said suction flow, and a separator, which rotates as an integral unit together with said fan, and said separator assembly is detachably provided via an air-seal at an opening of said contaminated-water tank, so that said contaminated-water tank, said separator assembly and said suction flow generating section can be communicated.

2. The cleaner for use in nursing care according to claim 1, further comprising a sensor installed in said main body casing, said sensor detecting whether or not said contaminated-water tank has been set in said storage section of said main body casing.

3. The cleaner for use in nursing care according to claim 1, wherein said separator assembly is supported by a supporting element and is communicated with said suction flow generating section, and said supporting element is installed so as to be pivotable between a set position and an open position, in said set position said supporting element being in a horizontal position so that said separator assembly is communicated with said opening formed in an upper portion of said contaminated-water tank, and in said open position said supporting element standing upright so that said separator assembly is separated from said contaminated-water tank.

4. The cleaner for use in nursing care according to claim 3, wherein said opening of said contaminated-water tank is formed with a larger diameter than a diameter dimension of said separator, a ring-form contaminated-water cover is detachably installed in said opening of said contaminated-water tank, and said separator assembly is detachably installed in said contaminated-water cover.

* * * * *